US008658273B2

(12) United States Patent
Rosset

(10) Patent No.: US 8,658,273 B2
(45) Date of Patent: Feb. 25, 2014

(54) SECURITY SHEET COMPRISING A TRANSPARENT OR TRANSLUCENT LAYER

(75) Inventor: Henri Rosset, Le Pin (FR)

(73) Assignee: Arjowiggins Security, Boulogne-Billancourt (FR)

( * ) Notice: Subject to any disclaimer, the term of this patent is extended or adjusted under 35 U.S.C. 154(b) by 1757 days.

(21) Appl. No.: 10/363,261

(22) PCT Filed: Sep. 10, 2001

(86) PCT No.: PCT/FR01/02803
§ 371 (c)(1),
(2), (4) Date: Aug. 20, 2003

(87) PCT Pub. No.: WO02/20902
PCT Pub. Date: Mar. 14, 2002

(65) Prior Publication Data

US 2004/0023008 A1 Feb. 5, 2004

(30) Foreign Application Priority Data

Sep. 11, 2000 (FR) ..... 00 11543

(51) Int. Cl.
*B41M 5/00* (2006.01)

(52) U.S. Cl.
USPC ..... 428/195.1; 428/162; 428/211.1; 428/537.5; 428/208; 428/206; 428/207; 283/57

(58) Field of Classification Search
USPC ..... 428/211, 195.1, 206, 207, 208, 162, 428/211.1, 537.5; 283/57
See application file for complete search history.

(56) References Cited

U.S. PATENT DOCUMENTS

| | | | | | |
|---|---|---|---|---|---|
| 3,899,621 | A * | 8/1975 | Willdorf | 428/216 |
| 4,324,421 | A * | 4/1982 | Moraw et al. | 283/75 |
| 4,425,421 | A * | 1/1984 | Rutges et al. | 430/238 |
| 4,501,641 | A * | 2/1985 | Hirakawa et al. | 162/164.3 |
| 4,844,976 | A * | 7/1989 | Huang | 428/323 |
| 5,391,686 | A * | 2/1995 | Jadhav et al. | 528/77 |
| 5,605,725 | A * | 2/1997 | Macaulay et al. | 427/557 |
| 5,660,919 | A * | 8/1997 | Vallee et al. | 428/206 |
| 5,868,902 | A * | 2/1999 | Howland et al. | 162/140 |
| 6,165,609 | A * | 12/2000 | Curatolo | 428/343 |
| 6,210,777 | B1 * | 4/2001 | Vermeulen et al. | 428/195.1 |
| 6,861,388 | B2 * | 3/2005 | Ishibashi et al. | 503/200 |

FOREIGN PATENT DOCUMENTS

| | | | |
|---|---|---|---|
| EP | 0 029 714 | A | 6/1981 |
| EP | 0 521 423 | A | 1/1993 |
| WO | WO 91 12372 | A | 8/1991 |

OTHER PUBLICATIONS

Cab-O-Sperse(R) PG 002 Product Form, Feb. 2006, www.cabot-corp.com.*

* cited by examiner

*Primary Examiner* — D. Lawrence Tarazano
*Assistant Examiner* — Tamra L Dicus
(74) *Attorney, Agent, or Firm* — Bacon & Thomas, PLLC

(57) ABSTRACT

The invention relates to a coated sheet of security paper which includes security elements and has a high print rendition and a high resistance to circulation, which sheet is characterized in that at least one of its sides is coated with a transparent or translucent coating comprising at least one colloidal silica and at least one transparent or translucent elastomeric binder. In particular, the binder is a polyurethane.
The invention also relates to the process for manufacturing the said sheet and to a banknote obtained from this sheet.

19 Claims, No Drawings

SECURITY SHEET COMPRISING A TRANSPARENT OR TRANSLUCENT LAYER

The invention relates to a security sheet that can be used to manufacture security documents, which is printable and has a high print quality, as well as a high resistance to circulation, especially after printing.

The invention relates more particularly to sheets of paper for banknotes or other certificates of value which may especially be printed by offset printing and/or by intaglio printing.

It is known that security documents, for example papers for banknotes or for cheques or for any other certificate of value, include chemical or physical authentication means and/or counterfeiting indicators.

In general, it is known to use, as chemical means, compounds which react with the counterfeiting agents commonly used by counterfeiters. These counterfeiting indicating means react, for example, with acids (hydrochloric acid, citric acid, acetic acid, sulphuric acid, etc.), with bases (especially sodium hydroxide), with oxidizing agents (especially bleach), with reducing agents and with solvents.

It is also known to use physical authentication means which are most often the following:

- the absence of optical brighteners fluorescent in the blue-violet when they are exposed to ultraviolet light, these being commonly used in ordinary paper in order to increase its brightness;
- the discrete presence of security elements (for example, threads, fibres, planchettes, etc.) which may exhibit variable optical effects, may be coloured or include inscriptions, or may have various physical properties such as magnetism, electrical conductivity, thermomagnetism, etc., and which may lie at least partly within the sheet;
- the presence of a watermark, that is to say a controlled modification of the density of the paper fibres in the thickness thereof, this watermark reproducing a given design which is perfectly visible only in transmitted light, that is to say when the paper is held up to the light;
- the presence of holograms, moiré patterns or other optical effects obtained with optically variable inks deposited on the surface of the sheet;
- the rattle of the paper, that is to say a characteristic sound obtained when the paper is given a rapid movement;
- the presence of printing on the surface of the paper in the form of patterns or inscriptions of complex colours or shapes which are consequently difficult to reproduce; and
- the relief of the printing obtained by the intaglio printing process, this process consisting in etching a plate, in spreading an ink over this plate and in pressing the sheet of paper onto the plate.

European Patent Application EP-A-514 455 describes a security sheet having a high resistance to circulation and good printability, this sheet including a coating made from mineral fillers and an elastomeric binder, particularly a polyurethane. One of the drawbacks of this sheet is that the security elements that it contains, such as the watermark, security thread, flakes or other elements having an especially variable optical effect, are less visible.

The aim of the invention is therefore to provide a sheet intended for the manufacture of security documents, particularly banknotes, which simultaneously has the following properties:

- very good visibility of the security elements that the sheet contains;
- high print quality; and
- high resistance to circulation, especially after printing, that is to say making the security document obtained from this sheet very durable.

The Applicant, after having tried numerous compositions containing at least one binder and at least one filler, has surprisingly succeeded in solving the problems posed by using a composition containing at least one colloidal silica and at least one transparent or translucent binder of elastomeric nature.

Thus, the invention provides a coated sheet of security paper which includes security elements and has a high print quality and a high resistance to circulation, which sheet is characterized in that at least one of its sides is coated with a transparent or translucent coating comprising at least one colloidal silica and at least one transparent or translucent elastomeric binder.

However, the elastomeric binder may be employed by mixing it with other binders normally used in papermaking, while taking care to ensure that the transparency of the coating is maintained without impairing its level of durability.

Preferably, the elastomeric binder is chosen from the group formed by the polyurethanes that can be used in the form of dispersions stabilized in an aqueous medium (latices).

Preferably, the said polyurethane is chosen from high-hardness polyurethanes; this seems to improve the antiblocking behaviour of the coating when handling the treated sheets.

Preferably, the said colloidal silica is a fumed silica.

Preferably, the silica has a specific surface area, measured according to the BET method (DIN 66 131 standard), of between 300 and 400 $m^2/g$, the BET method giving a measurement of the total specific surface area.

In particular, the said coating according to the invention is characterized in that it comprises:

1 to 95 parts by dry weight of the said silica, 5 to 99 parts by dry weight of the said elastomeric binder, the sum of the parts of these components making up a total of 100.

Also preferably, the said coating according to the invention is characterized in that it comprises:

30 to 50 parts by dry weight of the said silica, 50 to 70 parts by dry weight of the said elastomeric binder, the sum of the parts of these components making up a total of 100.

Within this range, it turns out that the coating gives the sheet, and the security document obtained, a particularly high overall resistance to circulation, while still allowing very good print quality. More particularly still, the said coating is characterized in that it comprises approximately 40 parts of the said silica and approximately 60 parts of the said binder, by dry weight, the sum of the parts of these components making up a total of 100, the result obtained appearing to be the optimum for this composition.

Preferably, the sheet according to the invention is characterized in that the said binder is combined with a crosslinking agent, in particular a polyaziridine.

The sheet according to the invention is characterized in that the weight of the coating deposited is between 1 and 15 $g/m^2$, preferably between 1 and 10 $g/m^2$ per side by dry weight, even more preferably between 2 and 7 $g/m^2$ per side by dry weight.

The coating may include other dispersing additives, viscosity modifiers, plasticizers and bacteriostatic agents, for example fungicides. It is not excluded for the coating to include other authentication or anti-counterfeiting agents.

The sheet to be treated according to the invention may be a sheet based on a composition of cellulose fibres and/or cotton fibres and/or synthetic fibres. The sheet may also be a sheet of synthetic material, especially such as the sheets used to make plastic banknotes. This sheet may consist of a single ply or of several plies.

Preferably, the sheet is a paper based on cotton fibres for banknotes and includes a wet-strength agent, especially a melamine-formaldehyde resin or a poly(aminoamide-epichlorohydrin) resin.

The invention also provides a process for manufacturing the said sheet.

The sheet is produced in particular using the process which is characterized in that it comprises the following steps:

- a sheet is formed on a papermaking machine which possibly includes a watermarking device, based on a cellulose and/or cotton fibres composition, a wet-strength agent and, optionally, planchettes;
- security elements, such as a security thread and/or elements with an optically variable effect, are optionally included in and/or on the sheet;
- optionally, the sheet is treated with a sizing agent in a size-press or impregnating press; and
- this sheet is then coated with a composition produced in an aqueous medium containing:
  - the said colloidal silica, used in the form of an aqueous dispersion,
  - the said elastomeric binder, used in the form of an aqueous dispersion,
  - where appropriate, a crosslinking agent,
  - optionally, other additives used in papermaking, and
  - the sheet is dried at around 100° C.

To deposit the said composition, any coating means standard in papermaking may be used, for example coaters of the gravure, reverse-roll, Champion, "Billblade", trailing-blade or air-knife type, or a film transfer system of the twin HSM type or an impregnator.

The invention also relates to a banknote obtained from a sheet as described above or obtained according to the process described above.

The following non-limiting examples will more clearly explain how the invention may be put into practice and its advantages.

EXAMPLE 1

Comparative Example

The sheet of paper was formed on a papermaking machine called a cylinder mould with a wire which included a pattern allowing a watermark to be produced, this paper possibly being suitable as a paper for manufacturing a banknote, in the following manner:

- a cotton fibres pulp was put into suspension in water and this suspension was refined to 60° Schoepper-Riegler;
- a wet strength agent was added, namely about 2.5% by dry weight of a poly(aminoamide epichlorohydrin), expressed with respect to the cotton fibres;
- iridescent planchettes were also introduced into this suspension;
- during formation of the sheet, a microprinted security thread, called a "window thread", was introduced using known prior techniques so as to make this thread visible in certain windows on the surface of the paper. One method that can be used to introduce this thread is described, for example, in Patent EP 59 056;
- after having formed the sheet, it was surface-treated in a size press using a sizing agent; and
- the sheet was dried at around 100° C.

The characteristics and results of the tests carried out on this sheet are given in Tables 1 to 3.

EXAMPLE 2

According to the Invention

A substrate was obtained according to Example 1, which was then coated using an air-knife coater with a composition made in an aqueous medium which comprised:

- 39 parts by dry weight of a polyurethane elastomeric binder sold under the name "CROMELASTIC SE871",
- 61 parts by dry weight of a fumed colloidal silica sold under the name "Cab-O-Sperse PG002" by the company Cabot,
- a polyaziridine crosslinking agent was added in an amount of 3 parts per 100 parts of the above components.

The viscosity was adjusted by means of rheology modifiers normally used in the field of printing/writing coatings for paper.

The weight of the coating deposited, by dry weight, was 4 $g/m^2$.

This sheet was printed using intaglio printing and was subjected to various tests.

The characteristics and results of these tests are given in Tables 1 to 3.

EXAMPLE 3

According to the Invention

Another example as in Example 2 was produced, but the weight of the coating deposited was 6 $g/m^2$ by dry weight.

The characteristics and results of these tests are given in Tables 1 and 2.

EXAMPLE 4

According to the Invention

A coated sheet was produced as in Example 2, but with the following amounts of binder and silica:

- 51 parts by dry weight of a polyurethane elastomeric binder sold under the name "CROMELASTIC SE871";
- 49 parts by dry weight of a fumed colloidal silica sold under the name of "Cab-O-Sperse PG002" by the company Cabot.

The characteristics and results of the tests carried out on this sheet are given in Tables 2 to 3.

EXAMPLE 5

According to the Invention

A coated sheet was produced as in Example 2, but with the following amounts of binder and silica:

- 61 parts by dry weight of a polyurethane elastomeric binder sold under the name "CROMELASTIC SE871";
- 39 parts by dry weight of a fumed colloidal silica sold under the name of "Cab-O-Sperse PG002" by the company Cabot.

The characteristics and results of the tests carried out on this sheet are given in Tables 2 and 3.

EXAMPLE 6

According to the Invention

A coated sheet was produced as in Example 2, but with the following amounts of binder and silica:

76 parts by dry weight of a polyurethane elastomeric binder sold under the name "CROMELASTIC SE 871";

24 parts by dry weight of a fumed colloidal silica sold under the name of "Cab-O-Sperse PG002" by the company Cabot.

The characteristics and results of the tests carried out on this sheet are given in Tables 2 and 3.

Tests and Results

The good printability of the sheets manufactured according to the invention was checked by intaglio and offset printing. The very good intaglio print quality was checked by scanning electron microscopy.

Their resistance to circulation after intaglio printing was tested according to the following criteria:

wet crumpling resistance;

wet rub resistance wet soiling resistance.

Moreover, the visibility of the security elements (planchettes, thread) through the coating was also checked.

The resistance-to-circulation tests with regard to crumpling resistance and rub resistance are described in the article entitled "Wearing quality of experimental currency-type papers", *Journal of Research of the National Bureau of Standards*, Volume 36, pages 249 to 268, March 1946.

The results are given in Table 2.

The wash-out resistance of the intaglio-printed specimens was tested in order to simulate passage through a washing machine. This wash-out resistance test was carried out on the printed sheets in the following manner:

A paper specimen was put in a flask containing water and a detergent, and placed on a TURBULA apparatus rotated for 1 hour. The degradation was assessed visually and according to an internal rating scale of 1 (minimum) to 5 (maximum). The results are given in Table 2.

The results were estimated visually [with the naked eye or with a magnifying device (magnifying glass, microscope)] and by comparison.

The wet soiling resistance test was carried out on the printed sheets in the following manner:

Each sheet of the examples was cut into several specimens.

Each specimen was subjected to crumpling in an IGT creasing apparatus. It was then uncreased manually and then put in a hermetically sealed flask together with ceramic beads 20 mm in diameter and a powder containing yellow and brown pigments, carbon black, vermiculite, an artificial sweat composition and a suintin composition.

The flask was placed in a TURBULA apparatus which was rotated for a total time of 15 minutes. In order to simulate the ageing of the specimens, for a given paper, the rate of soiling was measured by determining the brightness according to the ISO 2471 standard (reflectance at 457 nm) and the degree of yellow before soiling and then after a given time. These determinations were made on a specimen of paper after 5 minutes of soiling, these determinations were made on another specimen of the same paper after 10 minutes of soiling and the same determinations were repeated on another specimen after 15 minutes.

The degree of yellow was determined using an ELREPHO 2000 spectrocolorimeter in the CIE system under illuminant $D_{65}$ (daylight and without UV) and at an angle of observation of 10 degrees.

To assess the result, the differences in brightness or in degree of yellow before and after soiling for a given time were compared. The smaller the difference, the better the resistance. Thus, the average of the differences in both the brightness and the degree of yellow were calculated in order to have a measure of the average soiling resistance. The results are given in Table 3.

It may be seen that the print quality is significantly better in the case of the sheets produced according to the invention.

It may be seen that the overall resistance of the sheet to circulation (see Tables 2 and 3) is markedly better than that of the control. Compared with the other examples made according to the invention, it appears that the optimum overall resistance to circulation occurs in the case of Example 4.

For all the examples according to the invention, the watermark, the iridescent effect of the flakes and the inscriptions on the security thread can be clearly seen through the said coating.

TABLE 1

| | | Comparative Example 1 | Example 2 | Example 3 |
|---|---|---|---|---|
| Grammage | $g/m^2$ | 86.5 | 92.9 | 95.2 |
| Thickness | µm | 104 | 116 | 115 |
| Bulk | $cm^3/g$ | 1.20 | 1.25 | 1.21 |
| Bendtsen porosity | $cm^3/min$ | 7.85 | <5 | <5 |
| R/V Bekk smoothness | s | 35.6-30.4 | 21.0-14.8 | 24.6-17.6 |
| Opacity (paper backing) | % | 86.1 | 87.5 | 86.9 |
| Dry/wet burst | kPa | 459-234 | 452-238 | 464-226 |
| strength | % | 50.1 | 52.7 | 48.7 |
| Wet strength | | | | |
| Ash content | % | 1.87 | 6.12 | 6.93 |

TABLE 2

| | Wet crumpling resistance after 16 crumplings | Wash-out resistance after 1 hour | Wet rub resistance: number of to-and-fro rubs before the start of visual degradation is observed | |
|---|---|---|---|---|
| | | | WATER | BLEACH |
| Comparative Example 1 | 4.0 | 3.5 | 150 | <50 |
| Example 2 | 4.5 | 5.0 | 500 | 70 |
| Example 3 | 5.0 | 4.5 | 550 | 60 |
| Example 4 | — | 4.5 | 1000 | 120 |
| Example 5 | — | 4.0 | 1000 | 160 |
| Example 6 | — | 2.5 | 400 | 180 |

TABLE 3

| | | BRIGHTNESS | | | DEGREE OF YELLOW | | | Average of the differences in Brightness - degree of |
|---|---|---|---|---|---|---|---|---|
| | time | Before | after | difference | before | after | difference | yellow |
| Example 1 | 5 min | 79.79 | 65.76 | 14.03 | 8.92 | 22.14 | 13.2 | 13.6 |
| | 10 min | 79.82 | 65.32 | 14.50 | 8.85 | 22.43 | 13.6 | 14.0 |
| | 15 min | 79.76 | 66.29 | 13.47 | 9.01 | 21.53 | 12.5 | 13.0 |
| Example 2 | 5 min | 79.2 | 73.3 | 5.9 | 9.67 | 14.46 | 4.79 | 5.35 |
| | 10 min | 79.3 | 71.4 | 7.9 | 9.57 | 16.22 | 6.65 | 7.28 |
| | 15 min | 79.3 | 69.6 | 9.7 | 9.68 | 17.84 | 8.16 | 8.93 |
| Example 4 | 5 min | 79.3 | 72.7 | 6.6 | 9.73 | 15.20 | 5.47 | 6.04 |
| | 10 min | 79.0 | 70.0 | 9.0 | 10.17 | 17.69 | 7.52 | 8.26 |
| | 15 min | 79.2 | 67.1 | 12.1 | 9.96 | 20.26 | 10.3 | 11.2 |
| Example 5 | 5 min | 78.14 | 73.52 | 4.62 | 10.60 | 14.24 | 3.64 | 4.13 |
| | 10 min | 78.20 | 72.01 | 6.19 | 10.70 | 15.19 | 4.49 | 5.34 |
| | 15 min | 78.19 | 71.70 | 6.49 | 10.77 | 15.81 | 5.04 | 5.77 |
| Example 6 | 5 min | 77.78 | 74.02 | 3.76 | 11.12 | 13.94 | 2.82 | 3.29 |
| | 10 min | 77.80 | 72.76 | 5.04 | 10.90 | 14.43 | 3.53 | 4.29 |
| | 15 min | 77.89 | 71.82 | 6.07 | 10.75 | 15.42 | 4.67 | 5.37 |

The invention claimed is:

1. A coated sheet of security paper comprising cellulose fibers, cotton fibers, synthetic fibers or mixtures thereof, security elements and has a high print quality and a high resistance to circulation, at least one side of said sheet is coated with a coating comprising at least one fumed silica and at least one transparent or translucent elastomeric binder, characterized in that the coating is transparent or translucent and comprises:

30 to 50 parts by dry weight of colloidal silica, 50 to 70 parts by dry weight of said elastomeric binder, the sum of the silica and binder making up a total of 100.

2. The sheet according to claim 1, characterized in that the elastomeric binder is selected from the group consisting of polyurethanes in the form of stabilized aqueous dispersions.

3. The sheet according to claim 2, characterized in that said polyurethane is chosen from high-hardness polyurethanes.

4. The sheet according to claim 1, characterized in that said coating comprises approximately 40 parts of the said silica and approximately 60 parts of the said binder, by dry weight, the sum of the parts of these components making up a total of 100.

5. The sheet according to claim 1, characterized in that said coating includes a crosslinking agent.

6. A banknote paper comprising a security sheet according to claim 1.

7. The sheet according to claim 5, characterized in that said crosslinking agent is a polyaziridine.

8. A coated sheet of security paper comprising cellulose fibers, cotton fibers, synthetic fibers or mixtures thereof, security elements and has a high print quality and a high resistance to circulation, at least one side of said sheet is coated with a coating comprising at least one silica and at least one transparent or translucent elastomeric binder, characterized in that the coating is transparent or translucent and comprises:

30 to 50 parts by dry weight of colloidal silica, 50 to 70 parts by dry weight of said elastomeric binder, the sum of the silica and binder making up a total of 100; characterized in that the weight of the coating deposited is between 1 and 15 g/m2 per side by dry weight.

9. The sheet according to claim 8, characterized in that the weight of the coating deposited is between 1 and 10 g/m$^2$ per side by dry weight.

10. The sheet according to claim 9, characterized in that the weight of the coating deposited is between 2 and 7 g/m$^2$ per side by dry weight.

11. The sheet according to claim 8, characterized in that the weight of the coating deposited is between 2 and 7 g/m$^2$ per side by dry weight, the coating includes a crosslinking agent which is a polyaziridine, the binder is an elastomeric polyurethane, and the silica is a fumed silica.

12. The sheet according to claim 8, characterized in that the weight of the coating deposited is between 2 and 7 g/m$^2$ per side by dry weight and the binder is an elastomeric polyurethane and wherein said coating comprises approximately 40 parts of the said silica and approximately 60 parts of the said binder, by dry weight, the sum of the parts of these components making up a total of 100.

13. The sheet according to claim 1, wherein the sheet is a paper based on cotton fibres and contains a wet-strength agent.

14. The banknote paper of claim 6, wherein the paper is a paper based on cotton fibres.

15. The sheet according to claim 1, wherein the sheet is a paper based on cellulose fibers.

16. A banknote paper comprising a sized security sheet according to claim 1, with intaglio printing thereon.

17. A banknote paper comprising a sized security sheet according to claim 8, with intaglio printing thereon, wherein the weight of the coating deposited is between 2 and 7 g/m$^2$ per side by dry weight and is contiguous to the sheet, the coating contains a crosslinking agent which is a polyaziridine, the binder is an elastomeric polyurethane, and the silica is a fumed silica.

18. The sheet according to claim 1, wherein the sheet is a paper based on cellulose fibers, cotton fibers or a mixture thereof.

19. The sheet according to claim 8, characterized in that said silica has a specific surface area, measured according to the BET method (DIN 66 131 standard), of between 300 and 400 m$^2$/g.

* * * * *

UNITED STATES PATENT AND TRADEMARK OFFICE

CERTIFICATE OF CORRECTION

PATENT NO. : 8,658,273 B2
APPLICATION NO. : 10/363261
DATED : February 25, 2014
INVENTOR(S) : Henri Rosset It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2167 days.

Signed and Sealed this
Twenty-ninth Day of September, 2015

Michelle K. Lee

Michelle K. Lee
*Director of the United States Patent and Trademark Office*